US006580798B1

(12) United States Patent
Schaub

(10) Patent No.: US 6,580,798 B1
(45) Date of Patent: Jun. 17, 2003

(54) HEARING AID

(75) Inventor: Arthur Schaub, Wolfhausen (CH)

(73) Assignee: Bernafon AG, Bern (CH)

( * ) Notice: Subject to any disclaimer, the term of this patent is extended or adjusted under 35 U.S.C. 154(b) by 150 days.

(21) Appl. No.: 09/612,849

(22) Filed: Jul. 10, 2000

(30) Foreign Application Priority Data

Jul. 8, 1999 (CH) ..... 1256/99

(51) Int. Cl.[7] ..... H04R 25/00
(52) U.S. Cl. ..... 381/312; 381/316; 381/320
(58) Field of Search ..... 381/312, 316, 381/317, 318, 320, 321, 94

(56) References Cited

U.S. PATENT DOCUMENTS 4,630,304 A * 12/1986 Borth et al. ..... 381/94
5,029,217 A * 7/1991 Chabries et al.
5,892,836 A * 4/1999 Ishige et al. ..... 381/316

OTHER PUBLICATIONS

Alan Oppenheim & R. Schafer, *Digital Signal Processing*, ©1975, pp. vii–x & 239–271 (Prentice Hall, Englewood Cliffs, NJ, ISBN 01–13–214635–5).

B.W. Edwards et al., "Signal–processing algorithms for a new software–based, digital hearing device," pp. 44, 46–47, 50, 52, *The Hearing Journal*, vol. 51, No. 9, Sep. 1998.

www.widexcanada.com: "Experience the Senso 100% Digital Hearing Aid" sales literature, © 1998.

American National Standard ANSI S3.5–1997, "Methods for Calculation of the Speech Intelligibility Index," © 1998 Acoustical Society of America, pp. 1–22.

* cited by examiner

*Primary Examiner*—Sinh Tran
(74) *Attorney, Agent, or Firm*—Milton Oliver; Ware, Fressola, Van Der Sluys & Adolphson

(57) ABSTRACT

The suppression of interfering noise in an input signal (7) takes place in a main signal path (5), which contains neither a transformation in the frequency range nor a splitting-up into partial band signals, but only a suppression filter (4). The transmission function of the suppression filter (4) is periodically newly determined on the basis of attenuation factors, which are determined in a signal analysis path (6), which lies parallel to the main signal path (5). The attenuation factors are utilized for the attenuation of signal components in frequency bands with a significant proportion of interfering noise. The suppression filter (4) is implemented as transversal filter, the impulse response of which is periodically newly calculated as a weighted sum of the impulse responses of transversal band-pass filters. The signal analysis path (6) comprises transversal half-band filters **(1*a*–1*g*)** with successively reduced processing rate arranged in a tree structure, which enable a splitting up into partial signals in eight or more frequency bands with a high clearness of modulation. In this manner, processing with a low signal delay and an investigation of the proportion of interfering noise in a sufficient number of frequency bands becomes possible at all with a sufficiently high clearness of modulation

8 Claims, 1 Drawing Sheet

HEARING AID

CROSS-REFERENCE TO RELATED DOCUMENTS, WHICH ARE INCORPORATED BY REFERENCE

Figure 1:
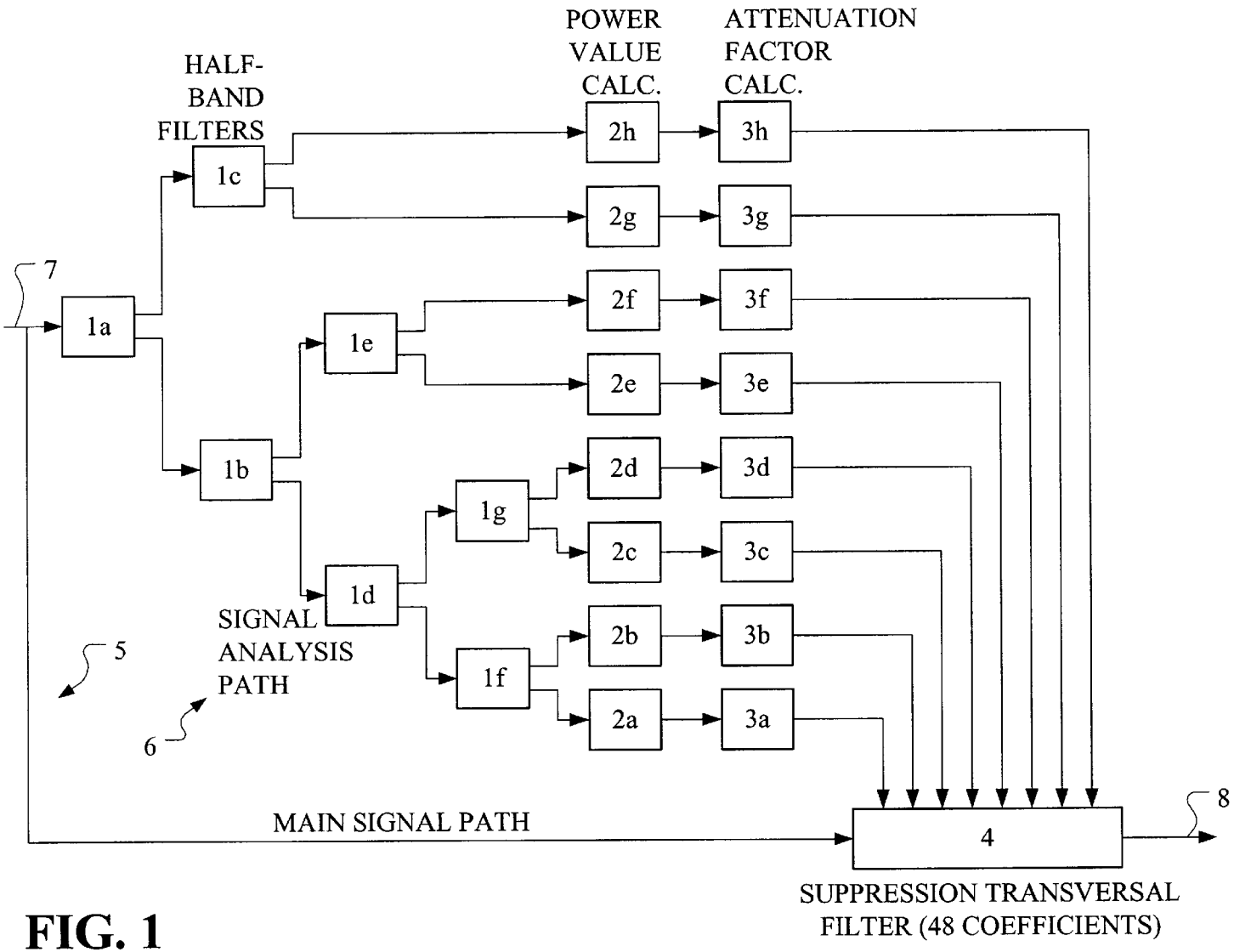

"Design of FIR [Finite Impulse Response] Filters Using Windows" in *Digital Signal Processing*, by Alan V. Oppenheim & Ronald W. Shafer (Prentice Hall, 1975).

FIELD OF THE INVENTION

The invention relates to a method of suppressing interfering signals in an input audio signal stream, and to a circuit for carrying out the method. The invention is suitable in particular for the improvement of the intelligibility of speech through the suppression of interfering noise in hearing aids or hearing devices.

BACKGROUND

For quite some time, it has been possible with conventional hearing aids to put people with impaired hearing in a position to understand speech, which is spoken in a quiet environment, well again. Difficulties occur, however, when the acoustic environment is full of interfering noise. Over and above the failure to understand speech, the wearers of hearing aids frequently complain that, in such situations, their devices produce an audio output signal which, for them, is unpleasantly loud. For the hearing situation involving interfering noises, various manufacturers have built, for this reason, in addition to using directional microphones, into their latest hearing devices, systems for the suppression of the interfering noise into their latest hearing devices.

Known in this connection are, e.g., the devices SENSO from Widex of Denmark, and PRISMA from Siemens AG of Germany. Both devices are characterized by a processing of the acoustic signal in several separate frequency bands. In the individual partial bands, an examination as to the presence of interfering noise takes place, and depending on the extent of the presence of interfering noise, the affected partial signals are correspondingly attenuated to a greater or lesser degree prior to their renewed re-assembly into a complete signal. The number of the frequency bands in the devices mentioned is limited to three or to four, respectively.

In a joint effort, the companies Resound of the U.S. and Danavox of Denmark have developed digital hearing aids, which are characterized by a processing of the acoustic signal in segments successive in time by means of Fast Fourier Transformation (FFT). The suppression of interfering noise, in the case of these devices, is based on fourteen frequency, bands, which according to the indications of the manufacturers, however, overlap to a great extent. Because of the low level of clarity of modulation when utilizing a maximum of only four frequency bands, resp., because of the great overlap of the fourteen frequency bands calculated from a Fourier transformation, the processes known LIS up to now for the suppression of interfering noise are, in essence, considered merely measures solely for making the output sound of the hearing devices more pleasant. They, however, hardly make any contribution to the objective improvement of the intelligibility of speech. As undesirable side effects, the processing in segments in addition produces a signal delay of more than 10 milliseconds.

It is an object of the present invention to provide a device and a method for the suppression of interfering noise, which objectively improves the intelligibility of speech and, apart from this, manifest an only short time delay (for example, less than 2 milliseconds) between the input signal and the output signal. The object is achieved by the circuit in accordance with the invention and the method disclosed below.

The point of departure for the invention is formed by the American National Standards Institute (ANSI) document S3.5-1997, "Methods for the Calculation of the Speech Intelligibility Index." In accordance with this standard document, for sufficiently well defined hearing situations, a numerical index value S can be calculated, which assumes real values between zero and one. It provides information about which proportion of the characteristics for speech intelligibility contained overall in spoken speech is accessible to a listener for the comprehension process in the brain in the given situation. For the specific results of a speech test, furthermore the degree of difficulty of the speech material as well as the linguistic competence of the listener are of significance. The decisive point, however, is that the test result in any case proves to be a monotonically increasing function of the index value S.

For the calculation of the index value S, the standard document indicates differing variants, which in the main differ with respect to the number of frequency bands, in which the speech—and noise signals are analysed. The minimum amounts to six bands and the maximum 21. In every variant, for each frequency band I a value $A_i$ for the audibility is established, and the index results as weighted sum $$S = \sum_i I_i \cdot A_i, \qquad \text{Equation (1)}$$

whereby $I_i$ designate constant, relative significance weightings (importance) for the individual partial bands, i.e., the sum of all these weightings amounts to one.

The values $A_i$ for the audibility for their part result as products $$A_i = L_i \cdot K_i, \qquad \text{Equation (2)}$$

whereby $L_i$ distortion values (distortion levels) and $K_i$ represent so-called temporary variables, into which the levels of the speech—and of the noise signal enter.

The distortion levels $L_i$ are calculated in accordance with $$L_i = 1-(E_i-U_i-10)/160, \qquad \text{Equation (3)}$$

whereby $U_i$ designate the levels of normal speech defined in the standard document, while $E_i$ represents the level of the speech signal in the investigated hearing situation.

The temporary variables $K_i$ finally are calculated in accordance with $$K_i = (E_i-D_i+15)/30, \qquad \text{Equation (4)}$$

whereby $D_i$ signify the levels of an interfering noise and the variables $K_i$ in all cases are limited to values between zero and one. In a quiet acoustic environment, the values $D_i$ result as levels of a fictitious interfering noise, which in general are determined by the hearing threshold values of people with normal hearing, resp., in the particular case by those of the individual person with a hearing impairment. In an acoustic environment with a considerable interfering noise, the values $D_i$, however, are determined by the external interfering noise plus in addition any masking effects, which are also caused by the interfering noise, by, however, its proportions in bands of lower frequency levels.

From the Equations (1) to (4) it evolves, that two conditions are necessary for achieving the maximum index value S=1. First of all the levels of the speech signal have to be at least 15 dB above those of the interfering noise in all frequency bands. And secondly, in no band must the level of the speech signal be more than 10 dB above that of normal speech $U_i$ in accordance with the definition of the standard document.

While in a quiet acoustic environment the speech levels in Equation (4) by means of amplification within a hearing device can be raised above the hearing threshold values $D_i$ of a person with impaired hearing and therefore the temporary values $K_i$ maximized, the situation under interfering noise is far less favourable. In this case, the amplification raises the levels of the speech signal and of the interfering noise to the same degree, and as soon as the latter exceed the hearing threshold values of the person with impaired hearing they are decisive for the values $D_i$, and any further increase of the temporary variables $K_i$ is therefore impossible.

Simultaneously the level values $E_i$ under these circumstances as a rule are significantly above those of normal speech $U_i$. With this, however, the prerequisites for an increasing of the index value S are also given in the interfering noise, this namely by a reduction of the amplification, as long as the distortion levels $L_i$ as a result of this once again approach the ideal value 1 and at the same time the temporary variables $K_i$ remain constant. A further desirable effect in addition results through the diminishing of masking effects, when the interfering noise has significant proportions in low frequency bands, which in practice is often the case.

SUMMARY OF THE INVENTION

The device in accordance with the invention, in particular an electronic circuit, for the suppression of interfering signals in an input signal contains means for the frequency-dependent attenuation of signal components. It has a main signal path with means for the frequency-dependent attenuation of signal components in the input signal, whereby an output signal of these means for the frequency-dependent attenuation is the output signal of the circuit. It furthermore has a signal analysis path lying parallel to the main signal path with means for the periodic calculation of frequency-dependent attenuation factors from the input signal. In the main signal path therefore neither a transformation in the frequency range nor a splitting-up into partial band signals is carried out; the main signal path preferably has only a suppression filter. The signal analysis path is connected with the main signal path in such a manner, that the attenuation factors are available to the means for the frequency-dependent attenuation.

The hearing aid in accordance with the invention contains the device according to the invention. In the case of the method in accordance with the invention for the suppression of interfering signals in an input signal, components of the signal are attenuated as a function of the frequency of each component. The input signal is split up into a main signal path and into a signal analysis path, which lies parallel to the main signal path. In the main signal path, the output signal of the circuit is generated, in that signal components are attenuated, dependent on the frequency; therefore, there neither a transformation in the frequency range nor a splitting-up into partial band signals is carried out in the signal analysis path, frequency-dependent attenuation factors from the input signal are periodically calculated. The attenuation factors are utilized for the frequency-dependent attenuation.

The invention permits an analysis of the input signal in a sufficient number of and in sufficiently sharply separated frequency bands without, in doing so, entailing an unreasonable signal delay. It simultaneously enables an efficient implementation with a moderate computing capacity.

BRIEF FIGURE DESCRIPTION

On the basis of an exemplary embodiment, in the following, the circuit in accordance with the invention, and the method according to the invention for the suppression of interfering noise are explained. A clear depiction of the example of an embodiment is provided in FIG. 1. In it, the reference numerals designate:

1*a* to 1*g* half-band transversal filter,

2*a* to 2*h* units for the calculation of a power value in short signal segments,

3*a* to 3*h* units for the calculation of an attenuation factor,

4 a suppression transversal filter

5 a main signal path,

6 a signal analysis path,

7 a signal input, resp., an input signal and

8 a signal output, resp., an output signal.

DETAILED DESCRIPTION OF A PREFERRED EMBODIMENT:

The method in accordance with the invention splits up the input signal at an input 7 into a main signal path with a suppression transversal filter 4 and into a signal analysis path 6 parallel to it with a block 1*a*–1*g*, 2*a*–2*h*, 3*a*–3*h* for the signal analysis. As can be seen from FIG. 1, the signal analysis in the example of an embodiment takes place in eight different frequency bands. On the eight outputs of the units 3*a* to 3*h*, the signal analysis periodically—in an exemplified embodiment every 32 ms—provides the values of the required reduction of amplification calculated for the different frequency bands. From this, the transversal filter 4 subsequently puts together the current transmission function respectively required for the suppression of the interfering noise.

In this manner, the signal delay from the input 7 of the processing up to its output 8 is determined solely by the suppression transversal filter 4. This filter 4 in the case of the example of an embodiment is a linear phase transversal filter with 48 coefficients, which in case of a scanning rate of 16 Khz produces a delay of 1.5 ms. Of course, in the signal analysis, longer delay times result, which, however, only have the effect, that the results from the analysis become effective in the processing path with a slight delay. This circumstance, however, is in general insignificant for the intended suppression of interfering noise, which is lasting in time. The only exception is the beginning of a speech signal after a longer pause in speech during the interfering noise. In this case, reductions in amplification effected during the pause in speech in those frequency bands, in which the speech levels dominate, have to be rapidly taken back. Precisely for this purpose, in the units 3*a* to 3*h* special provisions are incorporated, which will be explained in more detail at a later point in this description.

The favorable prerequisites for an efficient implementation of the method in accordance with the invention are concerned with the so-called half-band transversal filters 1*a* to 1*g* and their arrangement. In accordance with their designation, these filters 1*a* to 1*g* split-up their input signal into two partial signals, of which one has the lower half and the other one the upper half of the frequency band of its input signal. A half-band transversal filter therefore so-to-say simultaneously comprises a low-pass filter and a high-pass filter.

With the scanning rate of 16 kHz provided in the example of an embodiment, therefore the values listed in Table 1 are applicable to the different filters.

TABLE I

| | Filter | | | | | | |
|---|---|---|---|---|---|---|---|
| | 1a | 1b | 1c | 1d | 1e | 1f | 1g |
| Input [kHz] | 0 . . . 8 | 0 . . . 4 | 4 . . . 8 | 0 . . . 2 | 2 . . . 4 | 0 . . . 1 | 1 . . . 2 |
| Output 1 [kHz] | 0 . . . 4 | 0 . . . 2 | 4 . . . 6 | 0 . . . 1 | 2 . . . 3 | 0 . . . 1 | 1 . . . 1½ |
| Output 2 [kHz] | 4 . . . 8 | 2 . . . 4 | 6 . . . 8 | 1 . . . 2 | 3 . . . 4 | ½ . . . 1 | 1½ . . . 2 |

In an exemplified embodiment, a filter design common for transversal filters is applied. A detailed description can be found, e.g., in the chapter "Design of FIR Filters Using Windows" in the textbook "Digital Signal Processing" by Alan V. Oppenheim and Ronald W. Schafer, Prentice-Hall publishing company, which is hereby incorporated by reference.

For the low-pass filter there results because of $$b_k = \frac{h_k}{2\pi}\int_{-\pi/2}^{\pi/2}\exp(jk\omega)\,d\omega = \frac{h_k \sin(k\pi/2)}{k\pi}, \qquad \text{Equation (5)}$$

with $$h_k = 0.54 + 0.46\cdot\cos\left(\frac{k\pi}{K}\right) \qquad \text{Equation (6)}$$

and $$k\in[-K,+K], \qquad \text{Equation (7)}$$

whereby $h_k$ signify multiplicative constants (Hamming windows) and K is decisive for the filter order, that all filter coefficients $b_k$ with even index k, with the exception of k=0, disappear and that two coefficients respectively, those with index k and −k, are equal. With the selection K=15 in the example of an embodiment half-band transversal filters with 31 coefficients result, of which, however, only 17 coefficients are different from zero.

If the scanning values at the input of a half-band transversal filter are designated as x[n], then the scanning values $y_{TP}[n]$ at the output of the low-pass filter result in accordance with $$y_{TP}[n] = b_0\cdot x[n-K] + \sum_{k=1,3,\ldots}^{K} b_k\cdot(x[n-K-k]+x[n-K+k]). \qquad \text{Equation (8)}$$

Because for the coefficients of the high-pass filter $b_k' = (-1)^k\cdot b_k$ applies, the scanning values $y_{HP}[n]$ at the output of the high-pass filter result in accordance with $$y_{HP}[n] = b_0\cdot x[n-K] - \sum_{k=1,3,\ldots}^{K} b_k\cdot(x[n-K-k]+x[n-K+k]), \qquad \text{Equation (9)}$$

and therefore in the example of an embodiment nine multiplications and seventeen additions are sufficient for the calculation of both output signals.

As already mentioned, each one of the two output signals of a half-band transversal filter 1*a* to 1*g* only has the half bandwidth of the input signal. Therefore the scanning rate of the output signals can be reduced to half without any loss of information, i.e., for the further processing only every second output value is necessary. It goes without saying, that scanning values of output signals, which subsequently are not required anymore, also do not have to be calculated at all. For each half-band transversal filter 1*a* to 1*g* the calculation Equations (8) and (9) thus also only have to be carried out in every second scanning interval. For the arrangement of the half-band transversal filters 1*a* to 1*g* in the example of an embodiment, therefore a processing in sixteen different successive phases results. The following Table II shows, for which filters the calculation Equations have to be carried out in every phase. Important aspects in this are, that in every scanning interval at most two filters are concerned, that in all even-numbered phases even only one filter has to be calculated and that in phase 15 no filter calculation at all is necessary. These still free calculation resources are therefore available in an ideal manner for the calculation operations defined in the following in accordance with Equations (11)–(13) and (16).

TABLE II

| | Phase | | | | | | | | | | | | | | | |
|---|---|---|---|---|---|---|---|---|---|---|---|---|---|---|---|---|
| | 0 | 1 | 2 | 3 | 4 | 5 | 6 | 7 | 8 | 9 | 10 | 11 | 12 | 13 | 14 | 15 |
| Filter | 1a | 1b | 1a | 1d | 1a | 1b | 1a | 1f | 1a | 1b | 1a | 1d | 1a | 1b | 1a | — |
| Filter | — | 1c | — | 1e | — | 1c | — | 1g | — | 1c | — | 1e | — | 1c | — | — |

For an efficient implementation, for the summation of the expression in brackets $$(x[n-K-k]+x[n-K+k])$$

a particular adder shall be presupposed in addition to a multiplying accumulator unit. Based on the successive reduction of the processing rate, with a calculation unit like this the calculation effort for splitting-up the signal into eight partial signals of otherwise something more than 1,000,000 instruction cycles per second is reduced to only one fifth.

A further advantage also results for the clearness of modulation between adjacent frequency bands. With the successive reduction of the scanning rate, the filters with a lower bandwidth also have increasingly steeper flanks.

As already mentioned at an earlier point, the units 2*a* to 2*h* in FIG. 1 serve for the calculation of power values of short signal segments $$p = 10 \cdot \log10\left(\frac{1}{N}\sum_{n=1}^{N} y^2[n]\right), \qquad \text{Equation (10)}$$

which are necessary for the further processing in the logarithmic field, therefore in decibels. In the example of an embodiment, the duration of these time segments amounts to 32 ms. Because of the differing scanning rates, therefore the sums in Equation (10) in the units 2*a* to 2*d* comprise N=32 addends (summands), in the units 2*e* and 2*f*, N=64 is applicable, and in the units 2*g* and 2*h*, N=128.

With a view to an efficient implementation, in this context two aspects are of significance. First of all, for the transition to the logarithmic field the utilization of a combinatory circuit for the determination of the logarithmus dualis is recommended. Furthermore, in Equation (10) the division by N can be eliminated, which in the logarithmic field results in a displacement of the 0 dB point, which, however, is of no significance for the calculations in the following units 3*a* to 3*h*.

As also already mentioned at an earlier point in this description, with the units 3*a* to 3*h* it is calculated, how much reduction of amplification has to be applied in the different frequency bands. At the input of these calculation units 3*a* to 3*h*, in the example of an embodiment every 32 ms new logarithmic estimated values p arrive. In a first processing step, the variation range r of the signal powers in the individual partial signals shall be determined over the immediately past time period. For this purpose, separate estimated values for an upper barrier $s_o$ and a lower barrier $s_u$ are iteratively updated every 32 ms:

$$s_o := \max(s_o - \delta,\ p) \qquad \text{Equation (11)}$$

and $$s_u := \min(s_u + \delta,\ p), \qquad \text{Equation (12)}$$

whereby δ in the example of an embodiment amounts to 0.25 dB. The range of variation r is subsequently also iteratively updated with the help of the two barriers:

$$r := r + \gamma \cdot (s_o - s_u - r)^3, \qquad \text{Equation (13)}$$

whereby the scaling value γ is selected in the order of magnitude of $2 \cdot 10^{-4}/\text{dB}^2$. The calculation of the amplification reduction ΔG from a predefined value r finally takes place on the basis of an in part linear function.

$$\Delta G = \max(A - \beta \cdot r,\ 0), \qquad \text{Equation (14)}$$

with, for example, A=15 dB and β=1. With this selection, no reduction in amplification takes place, as long as the signal power in the time period recorded does not vary by more than 15 dB. If the range of variation in a partial signal, however, is below 15 dB, then the amplification in the corresponding frequency band is reduced by the difference to 15 dB. In the case of a long-lasting, constant signal level, a value of 0 dB results for the range of variation and therefore a maximum reduction of amplification of 15 dB.

The variation in function of time of the variable r is significantly determined by the values δ and γ, as well as by the application of the third power to the expression in brackets in Equation (13), which comprises the difference to the value up until now of r. The processing steps of the Equations (11) to (14) in a simple manner produce an asymmetrical characteristic in function of time, which corresponds to the practical requirements in an ideal manner. First of all, coincidental small differences in successive values of the signal power have practically no effect on the estimated value r. Secondly, a decrease of the range of variation r with a corresponding reduction of amplification ΔG can only be produced over a time period of several seconds. And finally, an abrupt increase of the signal power by a considerable amount, e.g., by 40 dB, has the effect, that a reduction in amplification of up to 12 dB from one time segment to the next is completely cancelled out.

In place of the logarithmic values ΔG, for the following further processing in the suppression transversal filter 4, linear attenuation factors a are required. In this, the conversion from the logarithmic to the linear field in an efficient implementation sensibly takes place with the help of a table. The output signal u[n] of the suppression transversal filter 4 finally is calculated in accordance with $$u[n] = \sum_{m=0}^{M-1} c_m \cdot (x[n - M - m] + x[n - (M - 1) + m]), \qquad \text{Equation (15)}$$

whereby in the example of an embodiment with the selection of M=24 the 48 coefficients result, which have already been mentioned at an earlier point. With the attenuation factors $a_j$, j=1, . . . , J=8 newly available every 32 ms, The coefficients $c_m$, m=0, . . . , M−1, in the Equation (15) are continually recalculated $$c_m = h_m \cdot \sum_{j=1}^{J} a_j \cdot c_{m,j}, \qquad \text{Equation (16)}$$

whereby $$h_m = 0.54 + 0.46 \cdot \cos\left(\frac{\left(m + \frac{1}{2}\right) \cdot \pi}{M - \frac{1}{2}}\right) \qquad \text{Equation (17)}$$

once again signify multiplicative constants (Hamming windows) and $$c_{m,j} = \frac{\sin\left(\left(m + \frac{1}{2}\right) \cdot \pi \cdot F_j\right) - \sin\left(\left(m + \frac{1}{2}\right) \cdot \pi \cdot f_j\right)}{\left(m + \frac{1}{2}\right) \cdot \pi} \qquad \text{Equation (18)}$$

are coefficients of transversal band-pass filters, in which $F_j$ define the upper and $f_j$ the lower band limit of the j-th frequency band, which is standardized relative to the Nyquist rate. With a Nyquist rate of 8 kHz in the example of an embodiment, therefore the values in accordance with Table III are applicable. In this, as already mentioned on the occasion of Tab. II, for the calculation of the Equation (16), for example, the scanning intervals with phase value 15 (refer to Tab. II) are available.

TABLE III

| | | | | | | | | |
|---|---|---|---|---|---|---|---|---|
| Frequency band j | 1 | 2 | 3 | 4 | 5 | 6 | 7 | 8 |
| Upper band limit [kHz] | ½ | 1 | 1½ | 2 | 3 | 4 | 6 | 8 |
| $F_j$ | 1/16 | ⅛ | 3/16 | ¼ | ⅜ | ½ | ¾ | 1 |
| Lower band limit [kHz] | 0 | ½ | 1 | 1½ | 2 | 3 | 4 | 6 |
| $f_j$ | 0 | 1/16 | ⅛ | 3/16 | ¼ | ⅜ | ½ | ¾ |

Equation (16), which is important for efficient implementation of the iterative recalculation of the filter coefficients, results from the fact that unit (4) is first of all configured as a parallel circuit of bandpass filters, the output signals of which are multiplied with the attenuation factors $a_j$ and then additively summed $$u[n] = \sum_j a_j \sum_m h_m \cdot c_{m,j} \cdot (x[n-M-m] + x[n-(M-1)+m])). \quad \text{Equation (19)}$$

By changing the sequence of the summation, the result is $$u[n] = \sum_m \left( h_m \sum_j a_j \cdot c_{m,j} \right) \cdot (x[n-M-m] + x[n-(M-1))+m]), \quad \text{Equation (20)}$$

which is identical with the Equations (15) and (16. The decisive aspect is, that the effort in case of a calculation in accordance with Equation (19) of approx. 3,200,000 instruction cycles per second, when transferring to the procedure in accordance with Equations (15) and (16) is reduced to now only one eighth.

Quite generally, the coefficients of a transversal filter simultaneously also represent its impulse response. This is also applicable for the suppression transversal filter 4 as well as for the transversal band-pass filters in accordance with Equation (18). Under this point of view, Equation (16) signifies, that the impulse response of the suppression transversal filter 4 is recalculated periodically as weighted sum of the impulse responses of transversal band-pass filters.

The invention has been explained here on the basis of an example of an embodiment. It goes without saying, that the invention is not limited to this one example of an embodiment. The person of ordinary skill in the art is in a position to derive further embodiments of the invention.

What is claimed is:

1. An electronic circuit device, for the suppression of interfering signals in an input signal (7), comprising means (4) for frequency-dependent attenuation of signal components, a main signal path (5) incorporating said means (4) for frequency-dependent attenuation of signal components in the input signal (7), an output signal ($u_n$) of these means (4) for frequency-dependent attenuation being an output signal (8) of the device, and a signal analysis path (6), lying parallel to the main signal path (5), said signal analysis path (6) comprising means (1*a*–1*g*, 2*a*–2*h*, 3*a*–3*h*) for periodic calculation of frequency-dependent attenuation factors ($a_j$), only from the input signal (7), wherein the signal analysis path (6) is connected to the main signal path (5) in such a manner that the attenuation factors ($a_j$) are applied to the means (4) for frequency-dependent attenuation; and the means (1*a*–1*g*, 2*a*–2*h*, 3*a*–3*h*) for the periodic calculation of the attenuation factors ($a_j$) have means (1*a*–1*g*) for splitting up the input signal (7) into at least eight practically not overlapping frequency bands and, for the purpose of determination of the range of variation (r) of signal powers (p) in immediately-past, short-time segments for every frequency band, contain means (3*a*–3*h*) for an iterative updating of separate estimated values ($s_o$, $s_u$) for upper and lower barriers.

2. Device in accordance with claim 1, wherein every means (3*a*–3*h*) for an iterative updating of the range of variation (r) of signal powers (p) on the basis of the upper and lower barrier ($s_o$, $s_u$) calculates the difference with respect to its previous value and cubes this difference.

3. In a circuit having parallel signal paths, a method of suppressing interfering signals in an input signal (7), wherein signal components are attenuated in dependence upon frequency, comprising splitting up the input signal (7) up into a main signal path (5) and into a signal analysis path (6) lying parallel to the main signal path (5), generating, in the main signal path (5), an output signal (8) by frequency-dependent attenuation of signal components, and periodically calculating, in the signal analysis path (6), frequency-dependent attenuation factors ($a_j$), only from the input signal (7), by splitting up the input signal into at least eight frequency bands with practically no overlap, and determining a range of variation (r) of signal powers (p) in immediately-past, short-time segments in every frequency band, including iterative updating of separate estimated values ($s_o$, $s_u$) for an upper barrier and a lower barrier, and utilizing the thus-calculated attenuation factors ($a_j$) for the frequency-dependent attenuation of signal components in said output signal generating step.

4. Method in accordance with claim 3, wherein, during the iterative updating of the range of variation (r) of signal powers (p), the difference with respect to its previous value is calculated on the basis of the upper and lower barrier ($s_o$, $s_u$) and this difference is cubed.

5. Method in accordance with claim 3, wherein the splitting-up of the input signal (7) takes place in a tree structure.

6. A device for the suppression of interfering signals in an input signal (7), with means (4) for frequency-dependent attenuation of signal components, a main signal path (5) incorporating said means (4) for frequency-dependent attenuation of signal components in the input signal (7), an output signal $u_n$ of these means (4) for the frequency-dependent attenuation being an output signal (8) of the device, and a signal analysis path (6) lying parallel to the main signal path (5), said signal analysis path (6) comprising means (1*a*–1*g*, 2*a*–2*h*, 3*a*–3*h*) for periodic calculation of frequency-dependent attenuation factors ($a_j$) from the input signal (7), said means (1*a*–1*g*, 2*a*–2*h*, 3*a*–3*h*) for periodic calculation of frequency-dependent attenuation factors ($a_j$) being configured to measure, in every one of a plurality of frequency bands, a range of variation (r) of signal powers (p) in an immediate past, an attenuation factor being the greater, the smaller the range of variation (r) is, wherein the signal analysis path (6) is connected to the main signal path (5) in such a manner that the attenuation factors ($a_j$) are available to the means (4) for frequency-dependent attenuation.

7. A device in accordance with claim 6, wherein said device is a hearing aid.

8. A method for suppression of interfering signals in an input signal (7), wherein signal components are attenuated in dependence upon the frequency, comprising the steps of splitting up the input signal (7) up into a main signal path (5) and into a signal analysis path (6) lying parallel to the main signal path (5), generating, in the main signal path (5), an output signal (8) by frequency-dependent attenuation of signal components, periodically calculating, in every one of a plurality of frequency bands in the signal analysis path (6), a range of variation (r) of signal powers (p), and calculating, from said range of variation (r), frequency-dependent attenuation factors ($a_j$), and using the attenuation factors ($a_j$) to perform said frequency-dependent attenuation of said signal components.

* * * * *